US011123769B2

(12) United States Patent
Lunnemann

(10) Patent No.: US 11,123,769 B2
(45) Date of Patent: Sep. 21, 2021

(54) ADJUSTABLE ROTATING WEIGHT

(71) Applicant: M-I L.L.C., Houston, TX (US)

(72) Inventor: Robert A. Lunnemann, Florence, KY (US)

(73) Assignee: Schlumberger Technology Corporation, Sugar Land, TX (US)

( * ) Notice: Subject to any disclaimer, the term of this patent is extended or adjusted under 35 U.S.C. 154(b) by 203 days.

(21) Appl. No.: 16/345,768

(22) PCT Filed: Oct. 18, 2017

(86) PCT No.: PCT/US2017/057069
§ 371 (c)(1),
(2) Date: Apr. 29, 2019

(87) PCT Pub. No.: WO2018/080852
PCT Pub. Date: May 3, 2018

(65) Prior Publication Data

US 2020/0047217 A1 Feb. 13, 2020

Related U.S. Application Data

(60) Provisional application No. 62/414,337, filed on Oct. 28, 2016.

(51) Int. Cl.
*B07B 1/42* (2006.01)
*B06B 1/16* (2006.01)
*B07B 1/28* (2006.01)

(52) U.S. Cl.
CPC ..... *B07B 1/42* (2013.01); *B06B 1/161* (2013.01); *B07B 1/284* (2013.01)

(58) Field of Classification Search
CPC ..... B07B 1/42; B07B 1/284
(Continued)

(56) References Cited

U.S. PATENT DOCUMENTS 3,352,418 A * 11/1967 Swallow ..... B07B 1/48 209/403
4,940,336 A * 7/1990 Dryga ..... B06B 1/163 310/81

(Continued)

FOREIGN PATENT DOCUMENTS

WO 2008/003156 A2 1/2008

OTHER PUBLICATIONS

Search Report R. 62 issued in European Patent Application 17864353.2 dated May 28, 2020, 4 pages.

(Continued)

*Primary Examiner* — Terrell H Matthews
(74) *Attorney, Agent, or Firm* — Jeffrey D. Frantz

(57) ABSTRACT

This disclosure is drawn systems, devices, apparatus, and/or methods related to the separation of a mixture of solids according to size and the separation of solids from liquid. Specifically, this disclosure is drawn to an adjustable weight set for use on vibratory separators. In some examples, the adjustable weight set may include a base plate rotatable about an axis and extending radially outward from the axis; a plurality of slots extending through the base plate and being disposed between a radially outward periphery of the base plate and the axis; a plurality of weights coupled to each other about the base plate; and a weight locking tab that partially surrounds the base plate that may include one or more hooks extending through a portion of a slot.

19 Claims, 3 Drawing Sheets

(58) Field of Classification Search
USPC ..... 209/366.5
See application file for complete search history.

(56) References Cited

U.S. PATENT DOCUMENTS

| | | | | |
|---|---|---|---|---|
| 5,134,893 | A * | 8/1992 | Hukki | B06B 1/163 366/128 |
| 6,401,933 | B1 * | 6/2002 | Cohen | B07B 1/005 209/366.5 |
| 2009/0269525 | A1 | 10/2009 | Kawano et al. | |

OTHER PUBLICATIONS

International Preliminary Report on Patentability for the equivalent International patent application PCT/US2017/057069 dated May 9, 2019.
International Search Report and Written Opinion for the equivalent International patent application PCT/US2017/057069 dated Feb. 1, 2018.

* cited by examiner

ADJUSTABLE ROTATING WEIGHT

The present document is based on and claims priority to U.S. Provisional Application Ser. No. 62/414,337, filed Oct. 28, 2016, which is incorporated herein by reference in its entirety.

BACKGROUND

Vibratory separators, which may be used to separate solids of a first size from solids of a second size or to separate solids from liquids, are used in many industries. For example, vibratory separators may be used in agriculture, biofuel, ceramics, chemical production, food and beverage production, mining, pharmaceuticals production, plastic separation and processing, powder coating, paper production and processing, recycling, shot peening, and wastewater separation industries.

Vibratory separators may separate a feed stream into one or more discharge streams, each discharge stream having a different particle size range. Often, vibratory separators have adjustable, three-dimensional vibration profiles. Vibratory separators often include a vertically mounted motor located below a separator stack comprising one or more frames and screens. The motor may include unbalanced, rotating weight sets disposed on the top and bottom of the motor. The weight set(s) may include a manual force adjustment mechanism and angle adjustment mechanism to adjust one weight or weight set relative to another weight or weight set. These adjustments enable adjustment of the three-dimensional vibration profiles of the vibratory separators.

The location of the motor often makes adjustment of the forces and angles of the weight set(s) difficult. Adjustment may require stopping the machine, removing guards from the machine, and an operator to reach into a dark space to adjust the unbalanced weights. This practical difficulty may make adjustment of the weights physically difficult and adjustment of the three-dimensional vibration profile imprecise.

For example, a conventional weight set may include a circular base plate and an axis of rotation near the center of the base plate. A plurality of weights, for example, two weights, may extend radially outward from the axis of rotation. The weights may be larger or thicker near a radially outward end. The weights may be adjustable to move independently of each other. The circular base plate may have a plurality of slots disposed 360 degrees around the base plate, and the weights may have notches sized and shaped to fit into the slots to maintain the position of the weight with respect to the base plate. The slots disposed around the base plate may be labeled and may be equally spaced from each other. In operation, the weight set rotates. When two weights are disposed on opposite ends of the base plate, the weight set becomes balanced, the forces of the weights cancel, and a net force of zero is imparted into the vibratory separator. As one or both weights are adjusted to move closer together, the weight set becomes unbalanced, and the net force imparted into the vibratory separator increases.

The weight set described in the paragraph immediately above suffers from a number of drawbacks. First, adjustment remains difficult, as an operator may still need to orient himself into an awkward or uncomfortable position to reach the weight set. The operator may need to maintain visual contact to identify the desired weight position all while maintaining haptic contact to manipulate the weight(s) to make the adjustment. These difficulties may result in longer vibratory separator down times, operator frustration, and/or operator injury. Furthermore, even if the slots are equally spaced about the circular base plate, for example, one slot every five degrees, the change in force as a weight is adjusted relative to the other is non-linear slot to slot. For example, if two weights are directly opposing each other in an initial position, an adjustment of one slot may yield a larger force change than a subsequent adjustment of one slot in the same direction. This non-linear force adjustment makes adjusting the weight set unpredictable, increasing the risk of dangerous vibrations to the vibratory separator and more down time if additional adjustments are needed.

BRIEF DESCRIPTION OF THE DRAWINGS

The foregoing and other features of the present disclosure will become more fully apparent from the following description and appended claims, taken in conjunction with the accompanying drawings. Understanding that these drawings depict several examples in accordance with the disclosure and are, therefore, not to be considered limiting of its scope, the disclosure is described with additional specificity and detail below through the use of the accompanying drawings.

In the drawings.

DETAILED DESCRIPTION

Figure 1:
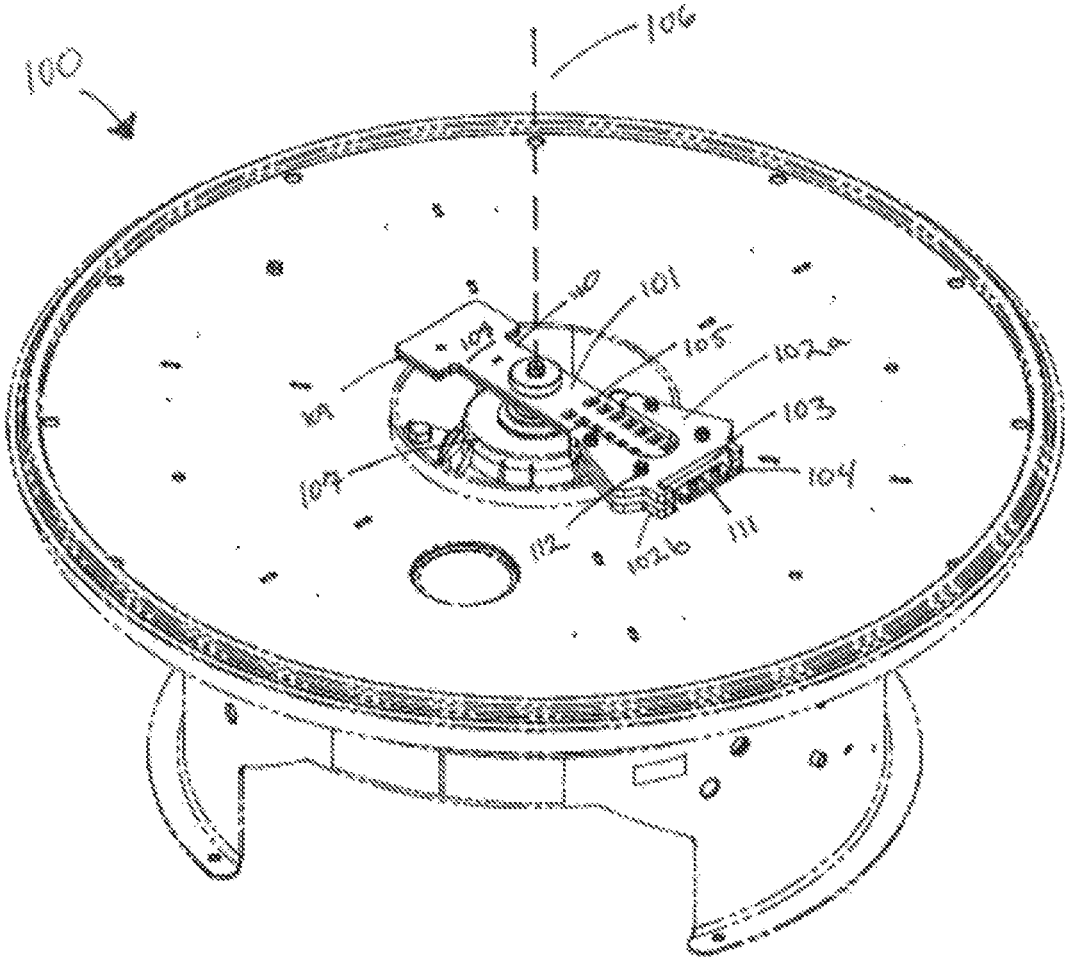
FIG. 1 depicts an isometric view of a portion of a vibratory separator having an exemplary adjustable weight set in accordance with the present disclosure.

In the following detailed description, reference is made to the accompanying drawings, which form a part hereof. In the drawings, similar symbols identify similar components, unless context dictates otherwise. The illustrative examples described in the detailed description and drawings are not meant to be limiting and are for explanatory purposes. Other examples may be utilized, and other changes may be made, without departing from the spirit or scope of the subject matter presented herein. It will be readily understood that the aspects of the present disclosure, as generally described herein and illustrated in the drawings, may be arranged, substituted, combined, and designed in a wide variety of different configurations, each of which are explicitly contemplated and made part of this disclosure.

This disclosure is generally drawn to systems, devices, apparatus, and/or methods related to the separation of a mixture of solids according to size and the separation of solids from liquid. Specifically, this disclosure is drawn to an adjustable weight set for use on vibratory separators.

FIG. 1 depicts an isometric view of a portion of a vibratory separator 100 having an exemplary adjustable weight set coupled to a motor 107 in accordance with the present disclosure. In this example, the adjustable weight set may include a base plate 101, which may be rotatable about an axis of rotation 106. Base plate 101 may include a top surface 108, a first side 109, a second side 110, and a bottom surface (not visible) opposite the top surface 108. Generally, first side 109 and second side 110 may refer to the opposing sides of the base plate 101 that extend radially outward from the axis of rotation 106.

The base plate 101 may include a plurality of slots 105 extending through the top surface 108 and the bottom surface of the base plate 101. In an embodiment, slots 105 may be arranged as lateral pairs of slots 105 (as is the case of the example embodiment of FIG. 1). Slots 105 may be equally spaced from each other. In an embodiment where slots 105 are arranged as lateral pairs, each pair of slots 105 may be equally spaced from each other pair. Slots 105 may be arranged linearly between the axis of rotation 106 and a radially outward periphery 111 of base plate 101.

An adjustable weight set according to the present disclosure may include weights 102(*a*), 102(*b*). Weights 102(*a*), 102(*b*) may be coupled to each other by a coupling mechanism 112. In an embodiment, coupling mechanism 112 may be bolts, but other coupling mechanisms will be apparent to those of skill in the art. A first weight 102(*a*) may be disposed above base plate 101, and a second weight 102(*b*) may be disposed below base plate 101. When weights 102(*a*), 102(*b*) are coupled together, one or both weights may contact top surface 108 and/or bottom surface of base plate 101. When weights 102(*a*), 102(*b*) are coupled together, they may be able to slide along a length of base plate 101. Weights 102(*a*) and/or 102(*b*) may include one or more flanges 104. An adjustable weight set according to the present disclosure may further include a weight locking tab 103, which is discussed in more detail below. In embodiments where they are included, one or more flanges 104 of weights 102(*a*) and/or 102(*b*) may be positioned radially outward of weight locking tab 103.

Figure 2:
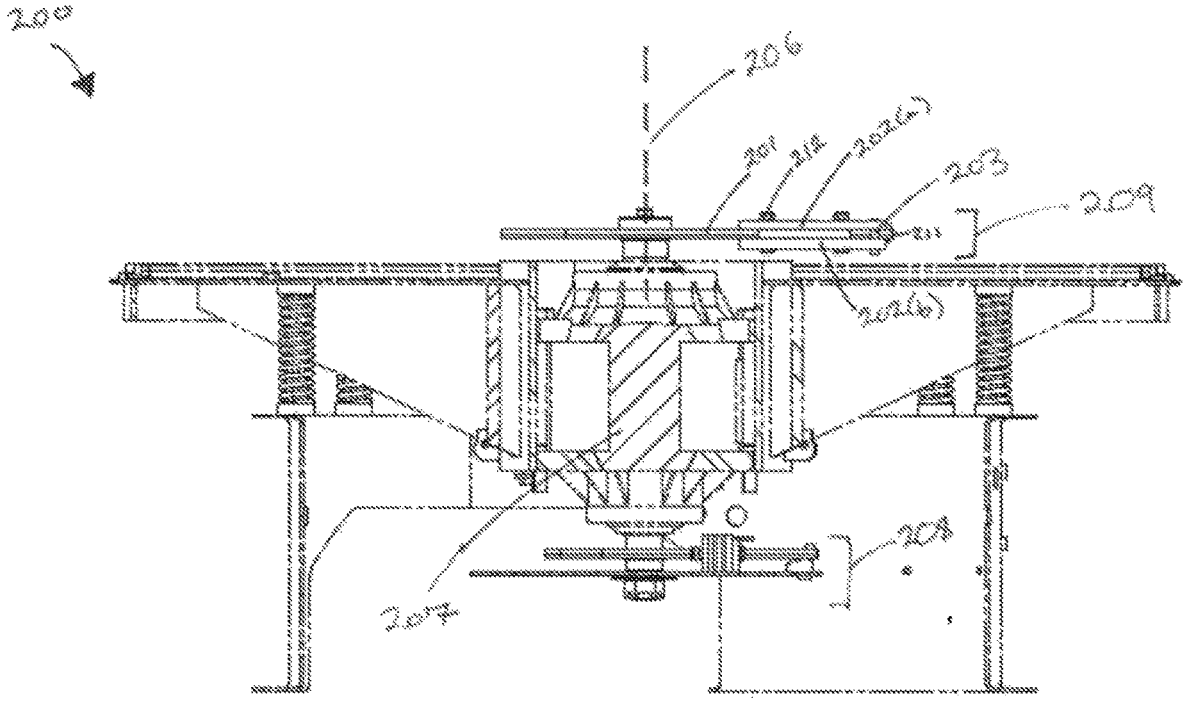
FIG. 2 depicts a side view of a portion of a vibratory separator having an exemplary adjustable weight set in accordance with the present disclosure.

FIG. 2 depicts a side view of a portion of a vibratory separator 200 having an exemplary adjustable weight set 209 in accordance with the present disclosure. A vibratory separator may include a vibratory motor that includes a vertically disposed motor 207, upper weight set 209, and lower weight set 208. Upper weight set 209 and/or lower weight set 208 may be adjustable. Upper weight set 209 and lower weight set 208 may rotate about axis of rotation 206. When upper weight set 209 and lower weight set 208 are unbalanced, they may induce vibratory force into a vibratory separator. In an embodiment, upper weight set 209 may induce vibratory force causing a frame and screen section to move horizontally, while a lower weight set may induce vibratory force causing a frame and screen section to move vertically. The force induced by a given weight set may be proportional to the amplitude of motion caused by the weight set. Adjustment of the upper and lower weight sets with respect to one another may cause changes in the phase angle of the vibratory motion.

Still with reference to FIG. 2, an upper weight set 209 may be an adjustable weight set in accordance with an embodiment of the present disclosure. Adjustable weight set may include base plate 201, weights 202(*a*) and 202(*b*), and weight locking tab 203. Weights 202(*a*), 202(*b*) may be coupled together by coupling mechanism 212. Base plate 201 may extend radially outward from axis of rotation 206 to radially outward periphery 211.

Figure 3:
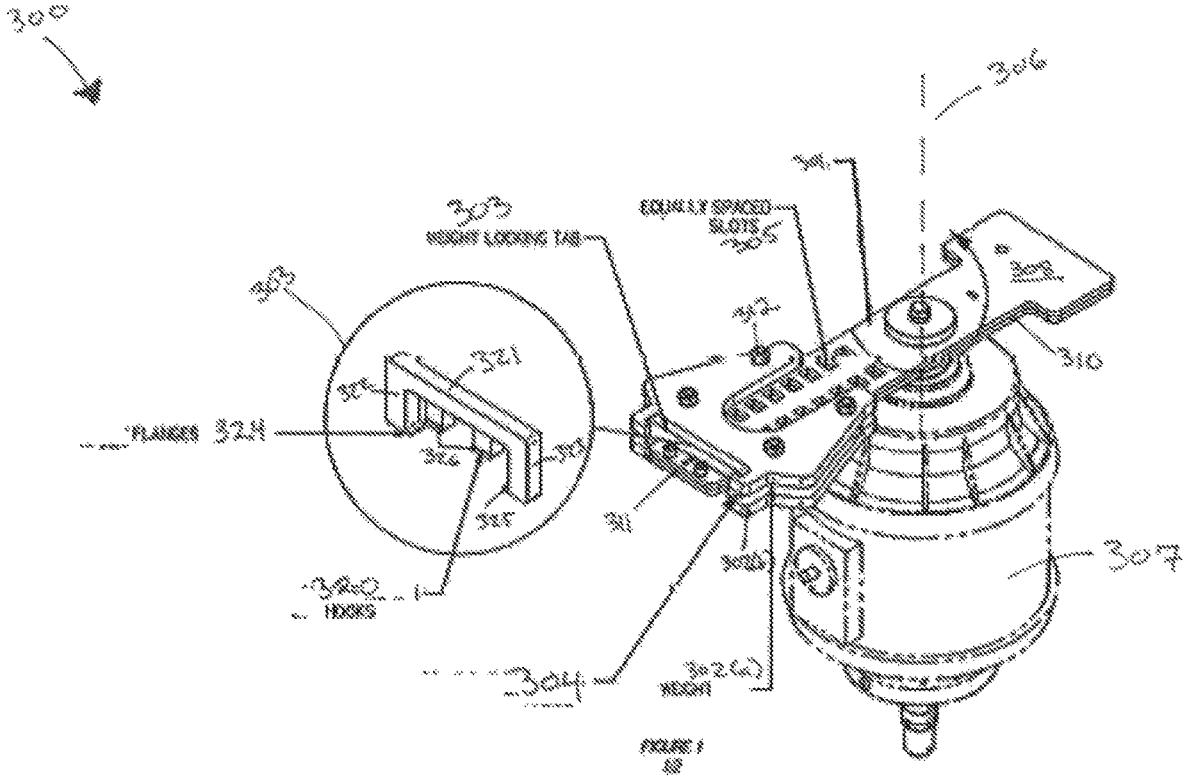
FIG. 3 depicts a perspective view of a motor for use in a vibratory separator with an exemplary adjustable weight set in accordance with the present disclosure attached thereto.

FIG. 3 depicts a perspective view of a motor coupled to an upper weight set 300 for use in a vibratory separator in accordance with an embodiment of the present disclosure. Shown in FIG. 3 is a motor 307 having an adjustable upper weight set coupled thereto. The weight set may include a base plate 301, which may be rotatable with respect to axis of rotation 306. From the perspective of FIG. 3, a top surface 308 and a second side 310 of the base plate 301 are visible. Base plate 301 may extend radially outward from axis of rotation 306 to a radially outward periphery 311. Base plate 301 may include a plurality of slots 305 disposed thereon. In an embodiment, slots 305 may be arranged as lateral pairs of slots 305 (as is the case of the example embodiment of FIG. 3). Slots 305 may be equally spaced from each other. In an embodiment where slots 305 are arranged as lateral pairs, each pair of slots 305 may be equally spaced from each other pair. Slots 305 may be arranged linearly between the axis of rotation 306 and a radially outward periphery 311 of base plate 301.

An adjustable weight set according to the present disclosure may include weights 302(*a*), 302(*b*). Weights 302(*a*), 302(*b*) may be coupled to each other by a coupling mechanism 312. In an embodiment, coupling mechanism 312 may be bolts, but other coupling mechanisms will be apparent to those of skill in the art. A first weight 302(*a*) may be disposed above base plate 301, and a second weight 302(*b*) may be disposed below base plate 301. When weights 302(*a*), 302(*b*) are coupled together, one or both weights may contact top surface 308 and/or bottom surface of base plate 301. When weights 302(*a*), 302(*b*) are coupled together, they may be able to slide along a length of base plate 301. Weights 302(*a*) and/or 302(*b*) may include one or more flanges 304. An adjustable weight set according to the present disclosure may further include a weight locking tab 303. In embodiments where they are included, one or more flanges 304 of weights 302(*a*) and/or 302(*b*) may be positioned radially outward of weight locking tab 303.

An embodiment of weight locking tab 303 is shown in more detail in FIG. 3. Weight locking tab 303 may include a top portion 321, a first side portion 322, a second side portion 323, a first flange 324, and a second flange 325. In an embodiment, top portion 321, first side portion 322, second side portion 323, first flange 324, and second flange 325 may be integrally formed. Weight locking tab 303 may further include one or more hooks 320. In an embodiment, hooks 320 may be integrally formed with the rest of weight locking tab 303. In an alternate embodiment, hooks 320 may be coupled to top portion 321 by a coupling mechanism or by a process such as welding. Herein, a hook 320 that is coupled to top portion 321 may include a hook being integrally formed with weight locking tab 303 or a portion thereof.

Top portion 321 of weight locking tab 303 may extend across top surface 308 of base plate 301. First side portion 322 may be coupled to (or be integrally formed with) top portion 321 and may extend from top surface 308 of base plate 301 past the bottom surface of the base plate 301 along a first side of base plate 301. Second side portion 323 may be coupled to (or be integrally formed with) top portion 321 and may extend from top surface 308 of base plate 301 past the bottom surface of the base plate 301 along second side 310 of base plate 301. First flange 324 may be coupled to (or be integrally formed with) first side portion 322 and may extend across at least a portion of the bottom surface of base plate 301. Second flange 325 may be coupled to (or be integrally formed with) second side portion 323 and may extend across at least a portion of the bottom surface of base plate 301. Herein, first flange 324 and second flange 325 may be said to extend across at least a portion of the bottom surface of base plate 301, but this does not necessarily require first flange 324 and second flange 325 to be touching the bottom surface of base plate 301. Rather, since, first side portion 322 and second side portion 323 may extend past the bottom surface of base plate 301, first flange 324 and second flange 325 may exist in a plane parallel to the plane defined by the bottom surface of base plate 301.

Hooks 320 of weight locking tab 303 may extend in the same direction as first side portion 322 and second side portion 323 but may be smaller. Hooks 320 may be sized and shaped to extend at least partially through slots 305. In the embodiment of FIG. 3, a pair of hooks 320 is provided on weight locking tab 303, corresponding to a pair of slots 305 on base plate 301. Hooks 320 may be sized such that hooks 320 extend through slots 305 when the underside of first portion 321 is resting on top surface 308 of base plate 301. First side portion 322 and second side portion 323 may be sized such that, when an operator lifts up on weight locking tab 303 to bring first flange 324 and second flange 325 into contact with the bottom surface of base plate 301, hooks 320 do not extend through slots 305. This may allow an operator to move weight locking tab 303 along base plate 301 to allow hooks 320 to extend through a different pair of slots 305.

In operation, the rotation of motor 307 may cause the adjustable weight set to rotate. During rotation, weights 302(*a*), 302(*b*) experience centrifugal force, which may cause weights 302(*a*), 302(*b*) to move radially outward. When hooks 320 of weight locking tab 303 extend through a pair of slots 305, weight locking tab 303 establishes a radially outward boundary, preventing further movement of weights 302(*a*), 302(*b*). The centrifugal force may maintain weights 302(*a*), 302(*b*) in a biasing relationship against weight locking tab 303 during operation. Hooks 320 may include flanges 326 to prevent weight locking tab 303 from rising upward during operation.

When weights 302(*a*), 302(*b*) are arranged to move radially inward or outward along base plate 302, the force imparted by the unbalanced weight set may change linearly when adjusted. An adjustable weight set may impart more vibratory force when weights 302(*a*), 302(*b*) are disposed radially outward compared to when weights 302(*a*), 302(*b*) are disposed radially inward. Because the amount of force may change linearly when adjustments are made, when slots 305 are equally spaced, each change in slot may change the force by an equal amount. This may allow for an greater predictability when an operator makes force adjustments to the weight set.

Further, an adjustable weight set according to the present disclosure may allow portions of weights 302(*a*), 302(*b*) to move through the center of rotation. This may allow centrifugal forces to begin to cancel each outer and may allow for a greater range of force output. For example, in FIG. 3, weights 302(*a*), 302(*b*) are geometrically shaped substantially in a U-shape, which may allow portions of weights 302(*a*), 302(*b*) to move through the center of rotation as described above when weight locking tab is adjusted radially inward. In such a configuration, the arms of the "U" shape may extend back toward the axis of rotation.

Slots 305 may be spaced linearly and may be equally spaced from each other, for example as shown in FIG. 3. As described above, such an arrangement of slots may allow for more predictable force adjustments. Furthermore, the weight locking tab 303 may allow an operator to more easily make force adjustments.

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. An adjustable weight set for a vibratory motor, comprising:

a base plate rotatable about an axis and extending radially outward from the axis, comprising:

a top surface;

a first side;

a second side; and a bottom surface;

wherein the top surface and the bottom surface of the base plate are in a plane that is substantially perpendicular to the axis;

a plurality of slots extending through the top surface and the bottom surface of the base plate, the slots being disposed between a radially outward periphery of the base plate and the axis;

a plurality of weights coupled to each other, wherein at least a first weight is disposed above the base plate, and wherein at least a second weight is disposed below the base plate; and a weight locking tab that partially surrounds the base plate comprising:

a top portion extending across the top surface of the base plate; and a hook coupled to the top portion and extending through at least a portion of a slot;

wherein the weights include flanges positioned radially outward of and contacting at least a portion of the weight locking tab.

2. The adjustable weight set of claim 1, wherein the weight locking tab further comprises:

a first side portion coupled to the top portion and extending from the top surface of the base plate past the bottom surface of the base plate along the first side of the base plate;

a second side portion coupled to the top portion and extending from the top surface of the base plate past the bottom surface of the base plate along the second side of the base plate;

a first flange coupled to the first side and extending across at least a portion of the bottom surface of the base plate; and a second flange coupled to the second side and extending across at least a portion of the bottom surface of the base plate;

wherein the hook is smaller than the first side portion and the second side portion and is sized such that, when the weight locking tab is lifted, the hook rises out of the slot.

3. The adjustable weight set of claim 1, wherein the slots are arranged linearly and are equally spaced from each other.

4. The adjustable weight set of claim 1, further comprising:

a plurality of lateral pairs of slots extending through the top surface and the bottom surface of the base plate;

wherein the lateral pairs of slots are disposed between a radially outward periphery of the base plate and the axis;

wherein the lateral pairs of slots are arranged linearly and are equally spaced from each other; and wherein the weight locking tab includes a pair of hooks coupled to the top portion, and each hook of the pair of hooks extends through at least a portion of a slot.

5. The adjustable weight set of claim 1, wherein the weights are U-shaped and have arms, and wherein the arms of the U-shape extend toward the axis.

6. The adjustable weight set of claim 1, further comprising:

a plurality of lateral pairs of slots extending through the top surface and the bottom surface of the base plate;

wherein the lateral pairs of slots are disposed between a radially outward periphery of the base plate and the axis;

wherein the lateral pairs of slots are arranged linearly and are equally spaced from each other;

wherein the weight locking tab further comprises:

a first side portion coupled to the top portion and extending from the top surface of the base plate past the bottom surface of the base plate along the first side of the base plate;

a second side portion coupled to the top portion and extending from the top surface of the base plate past the bottom surface of the base plate along the second side of the base plate;

a first flange coupled to the first side and extending across at least a portion of the bottom surface of the base plate; and a second flange coupled to the second side and extending across at least a portion of the bottom surface of the base plate;

wherein the weight locking tab includes a pair of hooks coupled to the top portion, and each hook of the pair of hooks extends through at least a portion of a slot;

wherein the hooks are smaller than the first side portion and the second side portion and are sized such that, when the weight locking tab is lifted, the hooks rise out of the slots; and wherein the weights are U-shaped and have arms, and wherein the arms of the U-shape extend toward the axis.

7. A vibratory motor for use in a vibratory separator, comprising:

a motor;

a lower weight set operatively coupled to a lower end of the motor; and an upper weight set operatively coupled to an upper end of the motor, the upper weight set comprising:

a base plate rotatable about an axis and extending radially outward from the axis;

a plurality of slots extending through the base plate between the axis and a periphery of the base plate;

a plurality of weights coupled to each other about the base plate; and a weight locking tab that partially surrounds the base plate comprising one or more hooks, wherein each hook extends through at least a portion of a slot.

8. The vibratory motor of claim 7, wherein the at least one hook is sized such that, when the weight locking tab is lifted, the hook completely rises out of the slot.

9. The vibratory motor of claim 7, wherein the slots are equally spaced from each other and are disposed linearly between the axis and the periphery of the base plate.

10. The vibratory motor of claim 7, wherein the slots are arranged as lateral pairs of slots disposed linearly between the axis and the periphery of the base plate;

wherein the lateral pairs of slots are equally spaced from each other; and wherein the weight locking tab includes a pair of hooks, each hook being sized and spaced to extend through at least a portion of a slot.

11. The vibratory motor of claim 7, wherein the weights are U-shaped and have arms, and wherein the arms of the U-shape extend toward the axis.

12. The vibratory motor of claim 7, wherein the slots are arranged as lateral pairs of slots disposed linearly between the axis and the periphery of the base plate;

wherein the lateral pairs of slots are equally spaced from each other;

wherein the weight locking tab includes a pair of hooks, each hook being sized and spaced to extend through at least a portion of a slot;

wherein the hooks are sized such that, when the weight locking tab is lifted, the hooks completely rise out of the slots; and wherein the weights are U-shaped and have arms, and wherein the arms of the U-shape extend toward the axis.

13. A vibratory separator, comprising:

one or more separator frames;

one or more separator screens positioned between the one or more separator frames; and a vibratory motor operatively coupled to the one or more separator frames and the one or more separator screens, the vibratory motor comprising:

a motor;

a lower weight set operatively coupled to a lower end of the motor; and an upper weight set operatively coupled to an upper end of the motor, the upper weight set comprising:

a base plate rotatable about an axis and extending radially outward from the axis;

a plurality of slots extending through the base plate between the axis and a periphery of the base plate;

a plurality of weights coupled to each other about the base plate; and a weight locking tab that partially surrounds the base plate comprising one or more hooks, wherein each hook extends through at least a portion of a slot.

14. The vibratory separator of claim 13, wherein the at least one hook is sized such that, when the weight locking tab is lifted, the hook completely rises out of the slot.

15. The vibratory separator of claim 13, wherein the slots are arranged linearly and are equally spaced from each other.

16. The vibratory separator of claim 13, wherein the slots are arranged as lateral pairs of slots disposed linearly between the axis and the periphery of the base plate;

wherein the lateral pairs of slots are equally spaced from each other;

wherein the weight locking tab includes a pair of hooks, each hook being sized and spaced to extend through at least a portion of a slot; and wherein the hooks are sized such that, when the weight locking tab is lifted, the hooks completely rise out of the slots.

17. The vibratory separator of claim 13, wherein the weights are U-shaped and have arms, and wherein the arms of the U-shape extend toward the axis.

18. The vibratory separator of claim 13, wherein the one or more separator frames are circular and the one or more separator screens are circular.

19. The vibratory separator of claim 13, further comprising:

a housing surrounding the one or more separator frames and the one or more separator screens, wherein the vibratory motor is coupled to the housing.

* * * * *